US010122070B2

(12) United States Patent
Wang et al.

(10) Patent No.: US 10,122,070 B2
(45) Date of Patent: Nov. 6, 2018

(54) DIVERSITY ANTENNA AND MOBILE TERMINAL

(71) Applicant: Beijing Xiaomi Mobile Software Co., Ltd., Beijing (CN)

(72) Inventors: Linchuan Wang, Beijing (CN); Zonglin Xue, Beijing (CN); Xiaofeng Xiong, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 174 days.

(21) Appl. No.: 15/347,790

(22) Filed: Nov. 10, 2016

(65) Prior Publication Data

US 2017/0271749 A1 Sep. 21, 2017

(30) Foreign Application Priority Data

Mar. 16, 2016 (CN) ..... 2016 1 0151249

(51) Int. Cl.

| | |
|---|---|
| ***H01Q 9/42*** | (2006.01) |
| ***H01Q 1/24*** | (2006.01) |
| ***H01Q 5/50*** | (2015.01) |
| ***H01Q 1/48*** | (2006.01) |
| ***H01Q 9/04*** | (2006.01) |
| ***H01Q 5/314*** | (2015.01) |
| ***H01Q 5/371*** | (2015.01) |

(52) U.S. Cl.

CPC ..... *H01Q 1/243* (2013.01); *H01Q 1/48* (2013.01); *H01Q 5/314* (2015.01); *H01Q 5/371* (2015.01); *H01Q 5/50* (2015.01); *H01Q 9/0421* (2013.01); *H01Q 9/42* (2013.01)

(58) Field of Classification Search

CPC ..... H01Q 1/243; H01Q 5/314; H01Q 5/371; H01Q 5/50; H01Q 1/48; H01Q 9/42

USPC ..... 343/702

See application file for complete search history.

(56) References Cited

U.S. PATENT DOCUMENTS

| | | | |
|---|---|---|---|
| 2012/0154225 | A1 | 6/2012 | Kanazawa |
| 2015/0155616 | A1 | 6/2015 | Lin |

FOREIGN PATENT DOCUMENTS

| | | | |
|---|---|---|---|
| CN | 103928752 | A | 7/2014 |
| CN | 104901000 | A | 9/2015 |

(Continued)

OTHER PUBLICATIONS

International Search Report for International Application No. PCT/CN2016/101021, dated Dec. 21, 2016.

(Continued)

*Primary Examiner* — Andrea Lindgren Baltzell

(74) *Attorney, Agent, or Firm* — Jun He Law Offices P.C.; James J. Zhu

(57) ABSTRACT

A diversity antenna applied in a mobile terminal and a mobile terminal are provided. The mobile terminal includes a metal housing and the metal housing includes a housing body and a receiving region located over the housing body, and the receiving region is a frame structure in which a side is provided with a slit. The diversity antenna includes a feed point, a first ground point and a second ground point, and the feed point, the first ground point and the second ground point are all arranged on the housing body, and a distance between the feed point and the slit is 3 mm to 15 mm. The diversity antenna further includes a capacitive element connected to the frame structure and arranged in series with the feed point, and a switch arranged in series with the first ground point.

20 Claims, 1 Drawing Sheet

(56) References Cited

FOREIGN PATENT DOCUMENTS

| | | | |
|---|---|---|---|
| CN | 104934706 | A | 9/2015 |
| CN | 204809379 | U | 11/2015 |
| CN | 105244620 | A | 1/2016 |
| CN | 205051738 | U | 2/2016 |
| EP | 3051631 | A1 | 8/2016 |
| WO | 2015085553 | A1 | 6/2015 |

OTHER PUBLICATIONS

Extended European Search Report for European application No. 16198845.6, dated Apr. 27, 2017.
International Search Report of PCT/CN2016/101021.

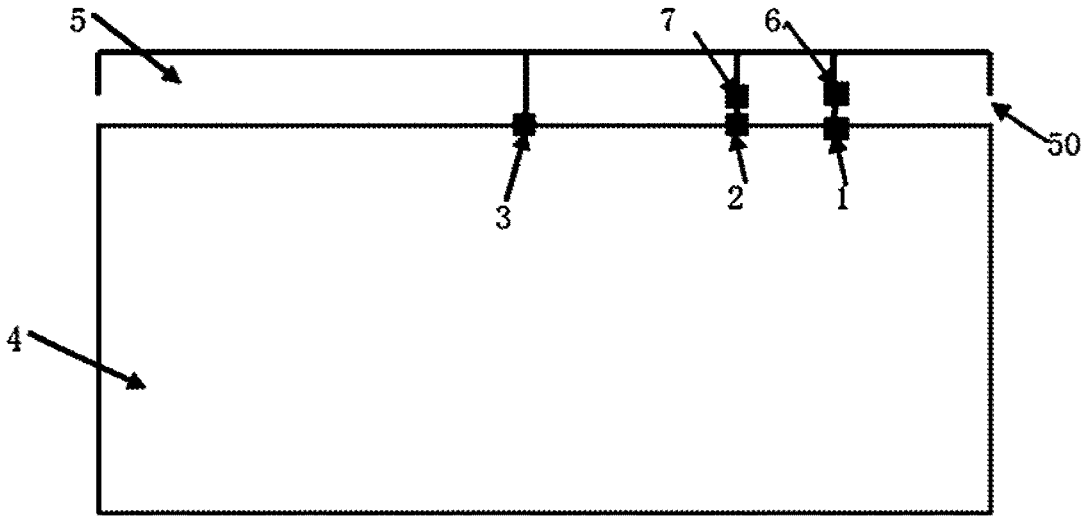
5
7
6
50
3
2
1
4

DIVERSITY ANTENNA AND MOBILE TERMINAL

CROSS-REFERENCE TO RELATED APPLICATIONS

The present application is based upon and claims priority to Chinese Patent Application No. 201610151249.1, filed Mar. 16, 2016, the entire contents of which are incorporated herein by reference.

TECHNICAL FIELD

The present disclosure generally relates to antennas, and more particularly, to a diversity antenna and a mobile terminal.

BACKGROUND

Nowadays, there are more and more metal elements applied in mobile phones, and an all-metal housing has gradually become mainstream of the appearance of the mobile phones. However, with the increase of metal, clearance of an antenna can be reduced, which affects outward radiation and signal reception of the antenna. Therefore, this brings challenge for the design of the antenna.

In view of the performance of a single antenna, the greater the clearance is and the less the metal in surrounding environment of the antenna is, the better the performance is. Therefore, for a mobile phone with a metal frame, if the frame is able to be used as a part of the antenna to radiate, better performance can be achieved.

For a conventional LTE antenna, operating frequency thereof needs to cover a full frequency band of 700 MHz to 2690 MHz. In general, even using the metal frame of the mobile phone as a part of the antenna to radiate, bandwidth is still very limited, in particular, the effect of using uncommon low frequency band at present is relatively poor, therefore, lines still need to be additionally disposed in other places inside the mobile phone to meet the required frequency band for covering. However, these additional disposed lines can only be arranged in a non-frame region, and thus the efficiency of the resulting resonant frequency is relatively poor.

SUMMARY

The present disclosure provides a diversity antenna and a mobile terminal.

According to one aspect of some embodiments, a diversity antenna applied in a mobile terminal is provided. The mobile terminal includes a metal housing and the metal housing includes a housing body and a receiving region located over the housing body, and the receiving region is a frame structure in which a side is provided with a slit. The diversity antenna includes a feed point, a first ground point and a second ground point, and the feed point, the first ground point and the second ground point are all arranged on the housing body, and a distance between the feed point and the slit is 3 mm to 15 mm. The diversity antenna further includes a capacitive element connected to the frame structure and arranged in series with the feed point, and a switch arranged in series with the first ground point.

According to another aspect of some embodiments, a mobile terminal is provided. The mobile terminal includes a metal housing and the metal housing includes a housing body and a receiving region located over the housing body, and the receiving region is a frame structure in which a side is provided with a slit. The mobile terminal further includes a diversity antenna and the diversity antenna includes a feed point, a first ground point and a second ground point, and the feed point, the first ground point and the second ground point are all arranged on the housing body, and a distance between the feed point and the slit is 3 mm to 15 mm. The diversity antenna further includes a capacitive element connected with the frame structure and arranged in series with the feed point and a switch arranged in series with the first ground point.

BRIEF DESCRIPTION OF THE DRAWINGS

FIG. 1 is a structural schematic diagram illustrating a diversity antenna, according to an exemplary embodiment.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of devices and methods consistent with aspects related to the present disclosure as recited in the appended claims.

The terminology used in the description of the disclosure herein is for the purpose of describing particular examples only and is not intended to be limiting of the disclosure. As used in the description of the disclosure and the appended claims, the singular forms "a", "an", and "the" are intended to include the plural forms as well, unless the context clearly indicates otherwise. It will also be understood that the term "and/or" as used herein refers to and encompasses any and all possible combinations of one or more of the associated listed items.

It shall be appreciated that although the present disclosure uses terminologies "first", "second", and "third" and the like to describe various information, the information shall not be limited by these terminologies. Using these terminologies is only for distinguishing information of the same type. For example, without departing from the scope of the present disclosure, the first information may be referred to as the second information, and similarly, the second information may be referred to as the first information. Depending on the context, the terminology "if" used herein may be interpreted as "when" or "in response to determining that . . . ".

Referring to FIG. 1, a diversity antenna of the present disclosure is applied in a mobile terminal. The mobile terminal includes a metal housing and the diversity antenna includes a feed point 1, a first ground point 2 and a second ground point 3. The metal housing includes a housing body 4 and a receiving region 5 located over the housing body, and the receiving region is a frame structure in which a side is provided with a slit 50. The feed point 1, the first ground point 2 and the second ground point 3 are all arranged on the housing body 4. A capacitive element 6 connected to the frame structure is arranged in series on the feed point 1, and a switch 7 is arranged in series on the first ground point 2. A distance between the feed point 1 and the slit 50 is 3 mm to 15 mm.

The capacitive element 6 is a tuning element, and is usually set to be a variable capacitor. The variable capacitor is connected to a top frame of the frame structure, and is used to switch low frequency of the diversity antenna, so that a mobile phone can change different capacitance values according to immediate use environment, and thus high frequency of the diversity antenna covers 1710 MHz to 2690 MHz is ensured.

The switch is a single-pole single-throw switch or a single-pole double-throw switch. The single-pole double-throw switch is used to switch the low frequency of the diversity antenna, when the switch is turned off, an operating frequency of the low frequency is 824 MHz to 960 MHz, which may be called as a first low frequency. When the switch is turned on, the operating frequency of the low frequency is 700 MHz to 820 MHz, which may be called as a second low frequency.

The first ground point 2 and the second ground point 3 are arranged at the same side of the feed point 1, and the first ground point 2 is arranged between the second ground point 3 and the feed point 1. A total path length of the feed point and the first ground point is less than a half wavelength of 800 MHz to 960 MHz, and a total path length of the feed point and the second ground point is less than a half wavelength of 700 MHz to 800 MHz. In a practical design, the operating frequency of the first low frequency can be adjusted by adjusting the distance between the first ground point and the feed point, and the operating frequency of the second low frequency can be adjusted by adjusting the distance between the second ground point and the feed point.

The capacitor (i.e., the capacitive element) is suspended. One end of the capacitor can be fixed on the top frame of the frame structure by screws and nuts, and the capacitor can also be directly integrated into the top frame.

The slits are provided at two sides of the frame structure. The slits of the mobile phone can be fully utilized to radiate. Thus, the size of the antenna can be effectively reduced, and performance of the antenna can be ensured.

The above-mentioned contents are only preferred embodiments of the present disclosure, instead of limiting the present disclosure, and any amendments, equal replacement and improvements made within the spirit and principle of the present disclosure should be contained in the scope protected by the present disclosure.

What is claimed is:

1. A diversity antenna applied in a mobile terminal having a metal housing, the metal housing comprising a housing body and a receiving region located over the housing body, the receiving region being a frame structure in which a side is provided with a slit, wherein the diversity antenna comprises:

a feed point, a first ground point and a second ground point, wherein the feed point, the first ground point and the second ground point are all arranged on the housing body, and a distance between the feed point and the slit is 3 mm to 15 mm;

a capacitive element connected to the frame structure and arranged in series with the feed point; and a switch arranged in series with the first ground point.

2. The diversity antenna according to claim 1, wherein the capacitive element is a variable capacitor.

3. The diversity antenna according to claim 2, wherein the switch is a single-pole single-throw switch or a single-pole double-throw switch.

4. The diversity antenna according to claim 1, wherein the first ground point and the second ground point are arranged at the same side of the feed point.

5. The diversity antenna according to claim 4, wherein the first ground point is arranged between the second ground point and the feed point.

6. The diversity antenna according to claim 1, wherein a total path length of the feed point and the first ground point is less than a half wavelength of 800 MHz to 960 MHz.

7. The diversity antenna according to claim 2, wherein a total path length of the feed point and the first ground point is less than a half wavelength of 800 MHz to 960 MHz.

8. The diversity antenna according to claim 3, wherein a total path length of the feed point and the first ground point is less than a half wavelength of 800 MHz to 960 MHz.

9. The diversity antenna according to claim 4, wherein a total path length of the feed point and the first ground point is less than a half wavelength of 800 MHz to 960 MHz.

10. The diversity antenna according to claim 5, wherein a total path length of the feed point and the first ground point is less than a half wavelength of 800 MHz to 960 MHz.

11. The diversity antenna according to claim 1, wherein a total path length of the feed point and the second ground point is less than a half wavelength of 700 MHz to 800 MHz.

12. The diversity antenna according to claim 2, wherein a total path length of the feed point and the second ground point is less than a half wavelength of 700 MHz to 800 MHz.

13. The diversity antenna according to claim 3, wherein a total path length of the feed point and the second ground point is less than a half wavelength of 700 MHz to 800 MHz.

14. The diversity antenna according to claim 4, wherein a total path length of the feed point and the second ground point is less than a half wavelength of 700 MHz to 800 MHz.

15. The diversity antenna according to claim 5, wherein a total path length of the feed point and the second ground point is less than a half wavelength of 700 MHz to 800 MHz.

16. The diversity antenna according to claim 1, wherein the capacitive element is suspended.

17. The diversity antenna according to claim 2, wherein the capacitive element is suspended.

18. The diversity antenna according to claim 3, wherein the capacitive element is suspended.

19. The diversity antenna according to claim 16, wherein the slits are provided at two sides of the frame structure.

20. A mobile terminal, comprising:

a metal housing comprising a housing body and a receiving region located over the housing body, wherein the receiving region is a frame structure in which a side is provided with a slit;

a diversity antenna comprising a feed point, a first ground point and a second ground point, wherein the feed point, the first ground point and the second ground point are all arranged on the housing body, and a distance between the feed point and the slit is 3 mm to 15 mm;

a capacitive element connected with the frame structure and arranged in series with the feed point; and a switch arranged in series with the first ground point.

* * * * *